US008297452B2

(12) United States Patent
Anscomb et al.

(10) Patent No.: US 8,297,452 B2
(45) Date of Patent: Oct. 30, 2012

(54) PARTS CONTAINER WITH ADJUSTABLE RACK

(76) Inventors: George A. Anscomb, Saginaw, MI (US); Jason V. Hultberg, Saginaw, MI (US)

( * ) Notice: Subject to any disclaimer, the term of this patent is extended or adjusted under 35 U.S.C. 154(b) by 0 days.

(21) Appl. No.: 13/457,618

(22) Filed: Apr. 27, 2012

(65) Prior Publication Data

US 2012/0211451 A1 Aug. 23, 2012

Related U.S. Application Data

(62) Division of application No. 12/586,588, filed on Sep. 24, 2009.

(60) Provisional application No. 61/194,208, filed on Sep. 25, 2008.

(51) Int. Cl.
*A47B 47/00* (2006.01)

(52) U.S. Cl. ..... 211/189; 211/175

(58) Field of Classification Search ..... 211/36, 211/189, 183, 193, 188, 194, 175, 41.14, 211/207, 208, 190–192; 108/55.1, 55.3, 108/108; 248/422, 292.12; 220/1.5, 651; 206/448, 49, 454, 319

See application file for complete search history.

(56) References Cited

U.S. PATENT DOCUMENTS

| | | | | |
|---|---|---|---|---|
| 3,147,860 | A * | 9/1964 | Kean, Sr. et al. | 206/448 |
| 3,809,234 | A * | 5/1974 | Kurick | 206/448 |
| 3,887,071 | A * | 6/1975 | Thomaswick | 206/454 |
| 3,995,738 | A * | 12/1976 | Rowley et al. | 206/451 |
| 4,074,823 | A * | 2/1978 | Pater et al. | 414/800 |
| 4,086,263 | A * | 4/1978 | Rowley | 206/454 |
| 5,145,073 | A * | 9/1992 | Kitagawa et al. | 211/41.14 |
| 5,154,310 | A * | 10/1992 | Massey | 206/505 |
| 5,671,854 | A * | 9/1997 | Thomas | 220/1.5 |
| 7,014,402 | B2 * | 3/2006 | Kessler | 410/155 |
| 7,293,666 | B2 * | 11/2007 | Mattlin et al. | 211/189 |
| 7,438,195 | B2 * | 10/2008 | Beck | 211/194 |
| 7,784,613 | B2 * | 8/2010 | Angeletti et al. | 206/448 |
| 7,878,340 | B1 * | 2/2011 | Olsen | 211/74 |
| 2004/0007550 | A1 * | 1/2004 | Leeman et al. | 211/189 |
| 2007/0119800 | A1 * | 5/2007 | Cornish | 211/60.1 |
| 2007/0119808 | A1 * | 5/2007 | Wishart et al. | 211/189 |
| 2008/0237225 | A1 * | 10/2008 | Owen | 220/1.5 |

* cited by examiner

*Primary Examiner* — Jennifer E. Novosad
(74) *Attorney, Agent, or Firm* — Robert L. McKellar; McKellar IP Law, PLLC

(57) ABSTRACT

A parts container having adjustable racks that are adjustable in both a vertical and horizontal direction.

1 Claim, 6 Drawing Sheets

PARTS CONTAINER WITH ADJUSTABLE RACK

This application is a new divisional patent application claiming priority from U.S. Provisional Patent application Ser. No. 61/194,208, filed Sep. 25, 2008 and U.S. Utility patent application Ser. No. 12/586,588, filed on Sep. 24, 2009.

The present invention deals with a device that is capable of holding automotive parts for shipment from one location to another. Primarily, it is constructed to hold various automotive components that are shipped from the manufacturer to the automobile company for assembly. The internal structure of the rack is adjustable allowing for a multitude of parts holding configurations.

BACKGROUND OF THE INVENTION

Parts racks or dunnage racks are not new to the art. The main obstacle to the continual use of the prior art racks is the parts that they are intended to carry change over time with each model changeover year creating a situation where new racks must be designed to carry the new model parts. The universal applicability of the adjustable rack of this invention makes it a true innovation in the art of dunnage racks.

THE INVENTION

Thus, what is disclosed and claimed herein is a parts container having adjustable racks. The container comprises a base, wherein the base is rectangular and comprised of intersecting and fixedly attached to each other, beam members, the base having support legs attached at each corner of the rectangle to support the parts container.

There are two side walls, each of the side walls being essentially square in configuration and each having a top and a bottom. The side walls have a top rail, a bottom rail, a front post and a back post, the top rail being attached near the top of the front post and the back post, the bottom rail being attached near the bottom of the front post and the back post.

The two side walls are connected together at the respective back posts by a support ladder, wherein the respective ends of the top rail are connected to each of the back posts near the top and the respective ends of the bottom rail are connected to each of the back posts near the bottom.

The support ladder has a top rail and a bottom rail and at least three vertical support posts each said vertical support having a top end, a bottom end, and oppositely opposed side walls.

There is a slider bar mount attached near the top end and the bottom end of each of the oppositely opposed side walls of each of the support posts, wherein the slider bars are mounted in and supported by said slider bar mounts such that the slider bars are suspended between the top rail and the bottom rail of the support ladder.

There are at least two support and adjustment posts having a front surface and slidably mounted on and located essentially between the top and bottom slider bars. The support and adjustment posts have a plurality of horizontal slots mounted on the front.

There is an adjustable arm mounted on each support and adjustment post, each adjustable arm comprised of a mounting bracket having a back wall, one side wall, and a front wall, said front wall having an internal surface and mounted on the internal surface, there are at least two mounting pins that are insertable into the horizontal slots of the support and adjustment post. There is an arm rail attached essentially horizontally to the front wall of the mounting bracket.

DETAILED DESCRIPTION OF THE DRAWINGS

Figure 1:
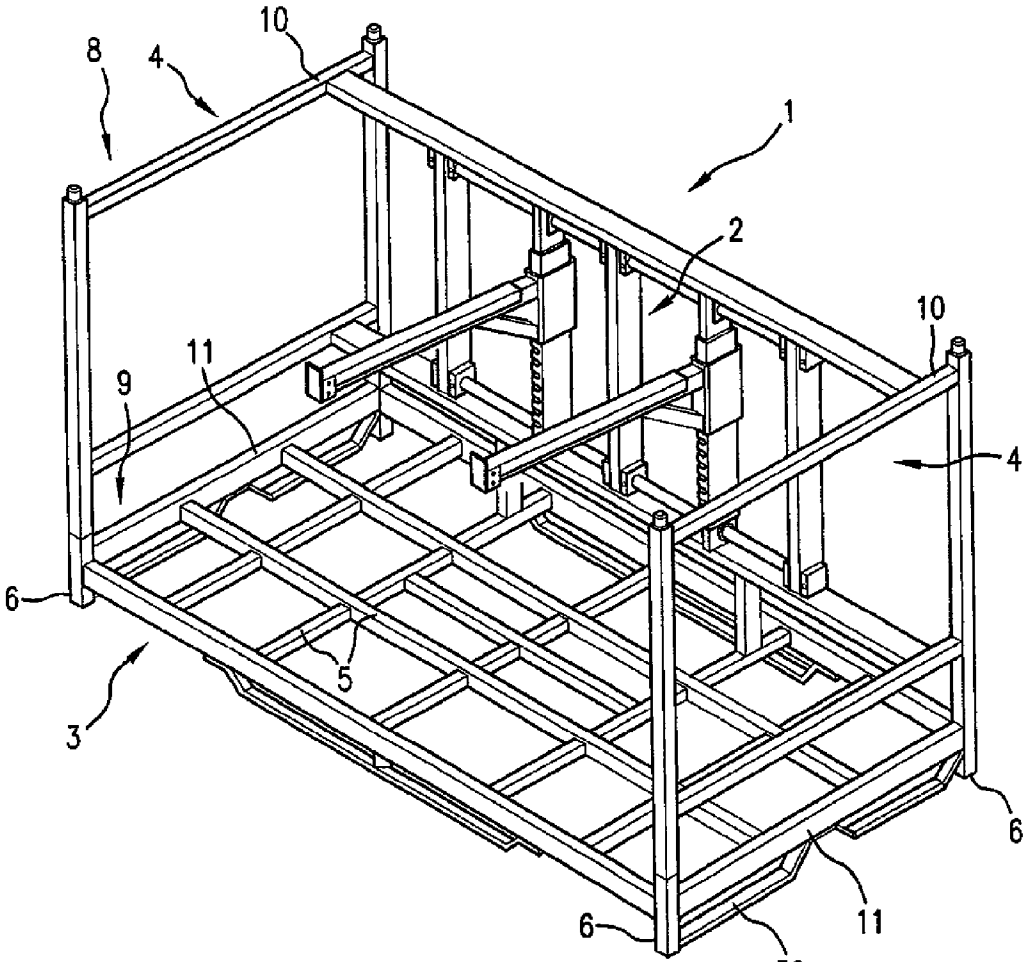
FIG. 1 is a view in perspective of a fully assembled container of this invention.

Turning now to FIG. 1, which is a full view in perspective of a fully assembled container of this invention showing the adjustable rack 2.

Regarding FIG. 1, the container 1 is configured as a cage-like structure and is fabricated from metal such as steel, iron, or aluminum, and in some cases, some of the parts are manufactured from plastic.

Typically, this container and pertinent parts are manufactured from round or tubular rails or piping and thus, the containers, with adjustable racks installed, weigh several hundred pounds.

The container 1 is configured from a base designated as 3 and two side walls, 4 and these components are welded together or bolted together to make them rigid. A combination of both forms of attachment can be used.

Figure 2:
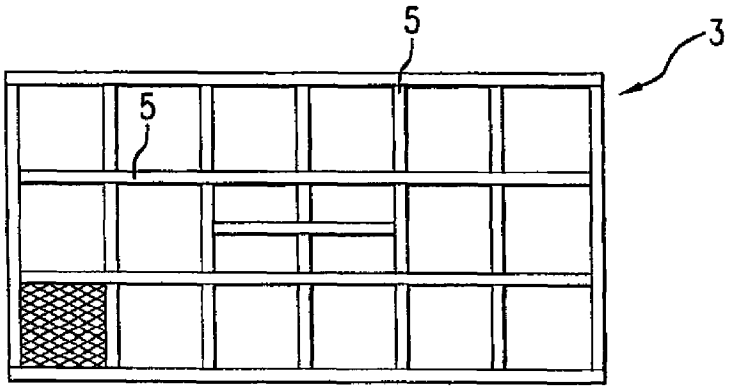
FIG. 2 is a top plan view of the base of this invention.

As shown in FIGS. 1 and 2, the base 3 is formed of a series of interconnecting and welded beams or rails 5 such that the base 3 will remain dimensionally stable and support a load of component car parts. Typically the beam rails have dimensions of from 2 to 4 inches and are either round or square. Square rails are preferred.

As shown in the Figures herein, the base 3 is rectangular in configuration, however, it can also be square in configuration and the definition of "rectangular' herein for purposes of this invention including both rectangular and square.

The side wall 4, and hence the base 3 has support legs 6 at each of the corners 7 of the side wall 4 to support the container 1 and essentially keep the bottom of the base 3 from sitting on the ground. This is so that one can lift the container 1 with a fork lift. It should be noted that the legs 6 can be part of the posts of the side wall or the legs 6 can be a separate component that is fitted to the bottom of the posts.

Figure 4:
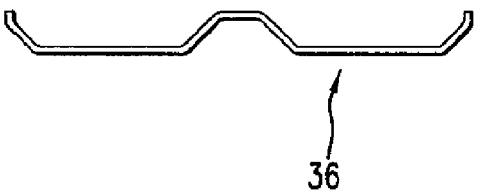
FIG. 4 is a full side view of a skid rail of this invention.

In addition, there can be fitted to the bottom rail 11 of the side wall 4 a skid member 36 (see FIGS. 4 and 1) that can be used to skid the container 1. In addition, it lends support to the bottom rail 11 when the container 1 is lifted by a fork lift.

Figure 3B:
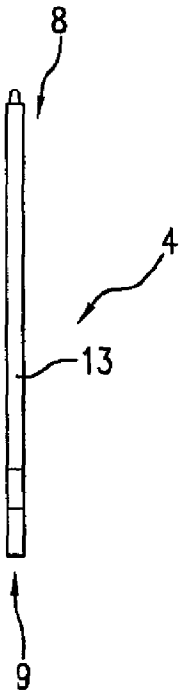
FIG. 3B is a full end view of the side wall of FIG. 3A.
Figure 3A:
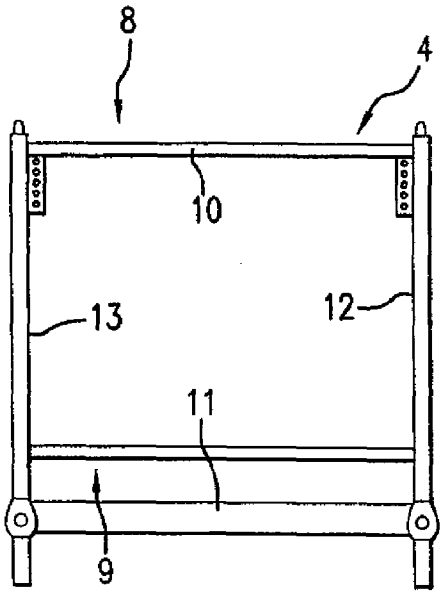
FIG. 3A is a full front view of a side wall of this invention.

As shown in FIGS. 1 and 3A, the side walls 4 are essentially identical in structure and are essentially square with a top 8 and a bottom 9. As with the rectangular configuration of the base, "square" herein also includes rectangular.

There is a top rail 10 and a bottom rail 11 that form the side wall 4. In addition, the rails 10 and 11 are supported on each end by a front post 12 and a back post 13. FIG. 3B is a full end view of the side wall 4 showing essentially only the back post 13

The two side walls are connected together at the back post 13 by a support ladder 14. The support ladder 14 (FIG. 7) is comprised of a top rail 15 and a bottom rail 16 and at least three vertical support posts 17.

The support ladder 14 is supported on its top rail ends 18 by welding the ends 18 of each the top rails 15 to the top rail 10 of the side wall 4 and the ends 19 of the bottom rail 16 to each of the bottom rails 11 of the side walls 4.

Typically the support ladder 14 supports three vertical support posts 17, but it is within the scope of this invention to have more than three vertical supports 17.

Figure 7:
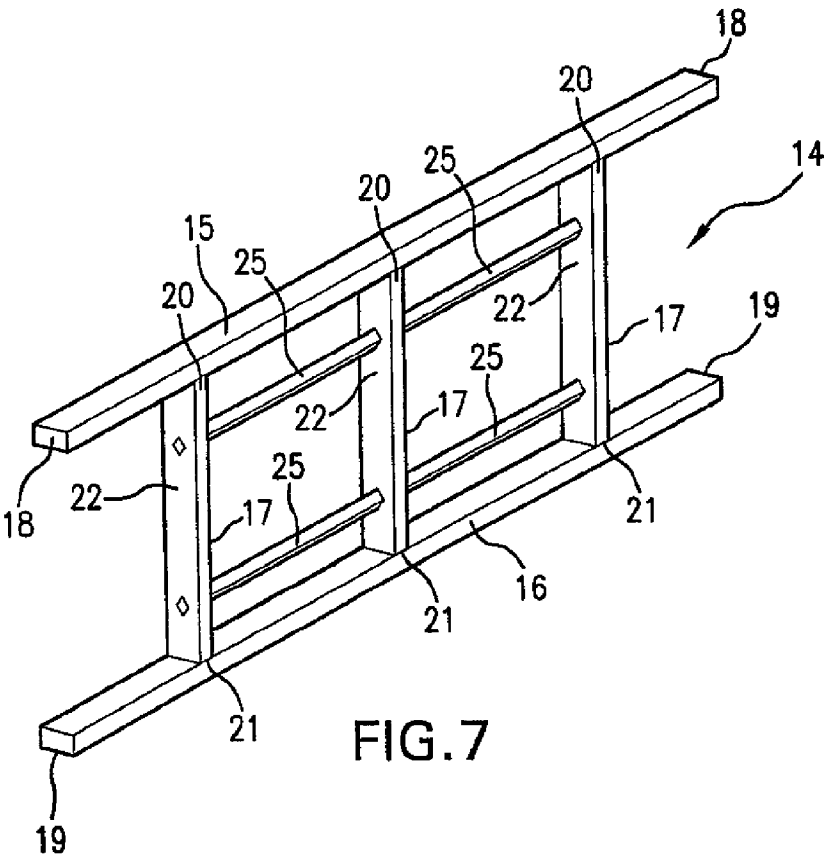
FIG. 7 is a view in perspective of the support ladder of this invention.

Each of the vertical support posts 17 have a top 20 and a bottom 21 and two oppositely opposed side walls 22 (in FIG. 7, only one side wall 22 is shown for each vertical post 17). Near the top 20 and the bottom 21 of each of the vertical support posts, there is mounted a slider bar mount 23 as shown in FIG. 7.

Each of the slider bar mounts has an opening 24 in the middle thereof. As shown, the openings 24 are diamond shaped (a square opening tipped up on one point of the square) to accommodate an end of a slider bar 25 as shown in FIG. 7. Note that the slider bar 25 is shown in FIG. 7 as a square tubular bar that is fastened in the clamp 27 such that one edge of the square tubular bar is pointed vertically. This way, the angle iron clamp 27 described infra will accommodate and fit the side edge of the square tubular bar.

The slider bars 25 are attached to an adjustable arm support post 26 with a detachable mechanism, and as shown, but not necessarily limiting is the use of an angle iron clamp 27 that fits over the slider bar 25 such that one edge 28 of the slider bar 25 fits into the connecting point 29 of the two legs 30 and 31 of the angle iron clamp 27.

Figure 6:
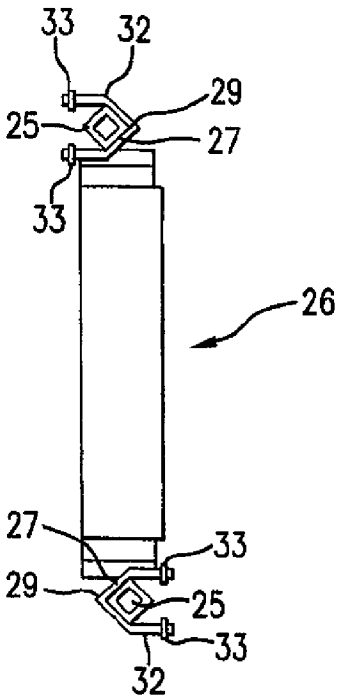
FIG. 6 is a full side view of the support and adjustment rail of FIG. 5.

The angle iron clamp 27 is then affixed with U-bolts 32 (FIG. 6, but not FIG. 8 for clarity) and fasteners, such as threaded nuts 33, and then tightened down to clamp the adjustable arm support post 26 (FIG. 5) to the slider bar 25 which prohibits the adjustable arm support post 26 from moving along the slider bar 25.

However, when it is desired to adjust the distance between the adjustable arm support posts 26 to accommodate certain automotive components to be carried by the container 1, then the U-bolts 32 are loosened and the adjustment is made, and the U-bolts 32 are then re-tightened.

It should be noted that the top rail 15 and the bottom rail 16 of the support ladder 14 are not tied into the side walls 4 at the back posts 13 of the side wall 4, but are set forward a few inches on the top rails 10.

Figure 5:
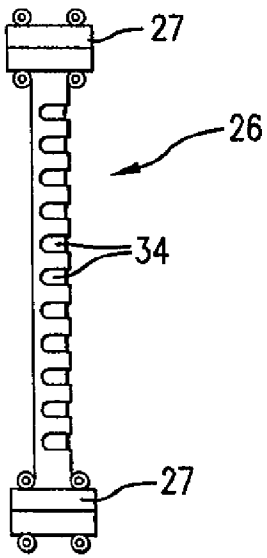
FIG. 5 is a full front view of the support and adjustment rail of this invention.
Figure 8:
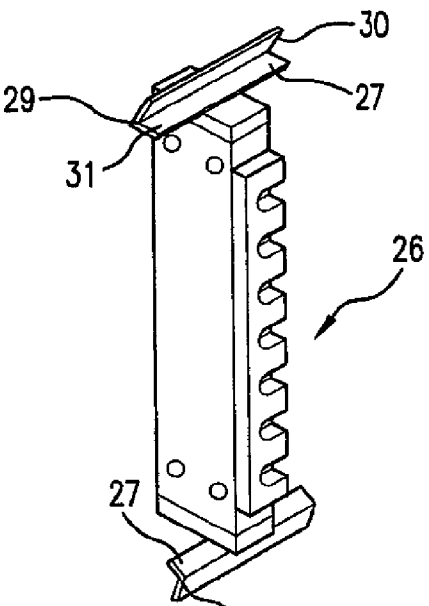
FIG. 8 is a view in perspective of a support and adjustment rail of this invention.

As can be noted from FIGS. 5 and 8, the front surface of the adjustable arm support posts 26 have mounted thereon a series of horizontal slots 34 that will be described infra with regard to the discussion regarding the adjustable arm 35.

Turning now to the adjustable arm 35 of this invention, and with reference to FIGS. 9, 10, 11 and 12, there is at least one of such arms 35 mounted on the support and adjustment post 26 (see FIG. 1).

Figure 9:
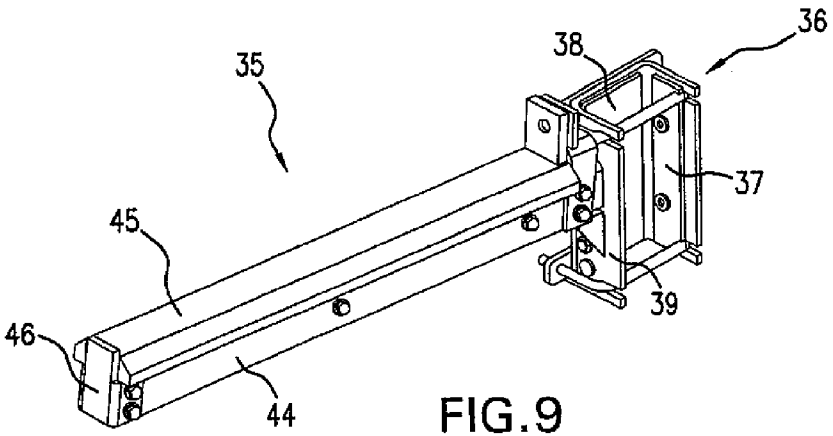
FIG. 9 is on embodiment of an adjustable arm of this invention showing no outrigger assembly.

One embodiment of the adjustable arm is shown in FIG. 9 which is a view in perspective of an arm 35 without an outrigger assembly 42.

The adjustable arms 35 are comprised of a mounting bracket 36 (see FIG. 9) on one end of the arm 35 and this bracket 36 has a back wall 37, one side wall 38 and a front wall 39 and these three walls are integrally formed. A second wall of the bracket does not exist as this is the entry point for the mounting bracket 36 to be laid over the adjustable arm support post 26. The front wall 39, the wall with the arm 35 attached thereto, has an internal surface 40 on which are mounted at least two locking pins 41 (see FIG. 12).

When the adjustable arm mounting bracket 36 is mounted onto the adjustable arm support post 26, the locking pins 41 insert into the horizontal slots 34. When the angle iron claim 27 is fitted to the slider bar 25 and fastened down, the locking pins 41 prevent the adjustable arm 35 from bending downwardly.

Figure 10:
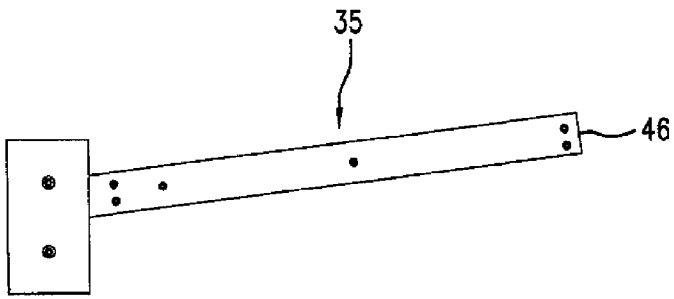
FIG. 10 is a full side view of the adjustable arm of FIG. 9.
Figure 12:
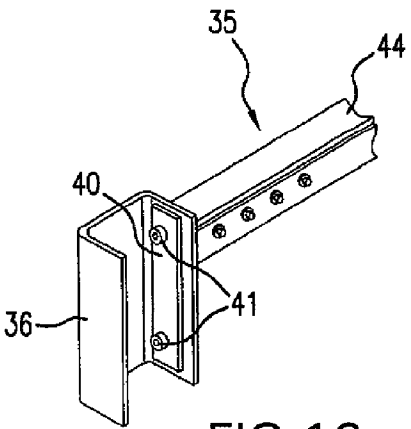
FIG. 12 is a view in perspective of a portion of the adjustable arm showing the locking pins on the mounting end of the arm.

FIG. 10 is a full side view of the arm 35 as shown in FIG. 9.

Mounted fixedly to the front surface 43 of the front wall 39 is the arm rail 44. The top 45 of the arm rail 44 is configured to fit various parts that will be transferred on the rail 44. Preferably, the outer most end 46 of the arm rail 44 is tilted upwardly just slightly to prevent the transferred components from sliding forward on the rail. This is what is meant by "essentially" with regard to horizontal attachment of the arm rail 44 to the front surface of the mounting bracket 36. The tops 45 are configured to accommodate the line of the various components so that the arm rail 44 does not scratch bend or cut the edges of the components.

Because of the plurality of the horizontal slots 34 and because these slots 34 are vertically aligned, they provide the vertical adjustability of the adjustable arm rail 35. Thus, the adjustable arm can be adjusted vertically and horizontally to provide for a wide variety of automotive parts allowing the container 1 to be universally used.

Figure 11:
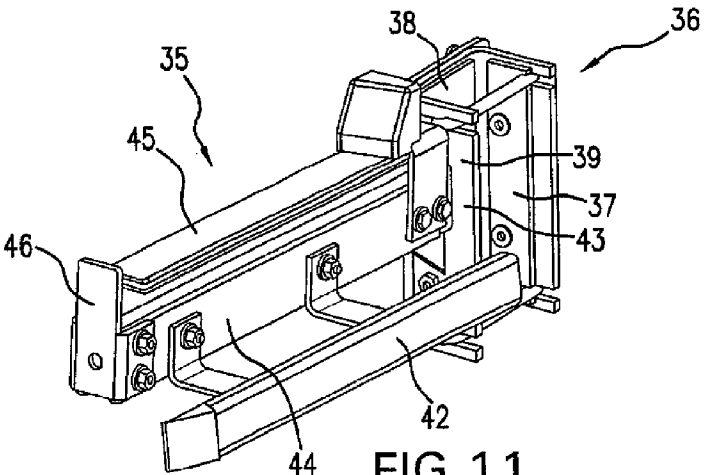
FIG. 11 is another embodiment of an adjustable arm of this invention showing an outrigger assembly.

FIG. 11 is another embodiment of this invention in which there is added to the arm rail 44, an outrigger assembly 42 which is designed to accommodate certain automotive components that will not transfer smoothly on the regular arm 44 of the adjustable arm 35 of FIG. 9.

Figure 13:
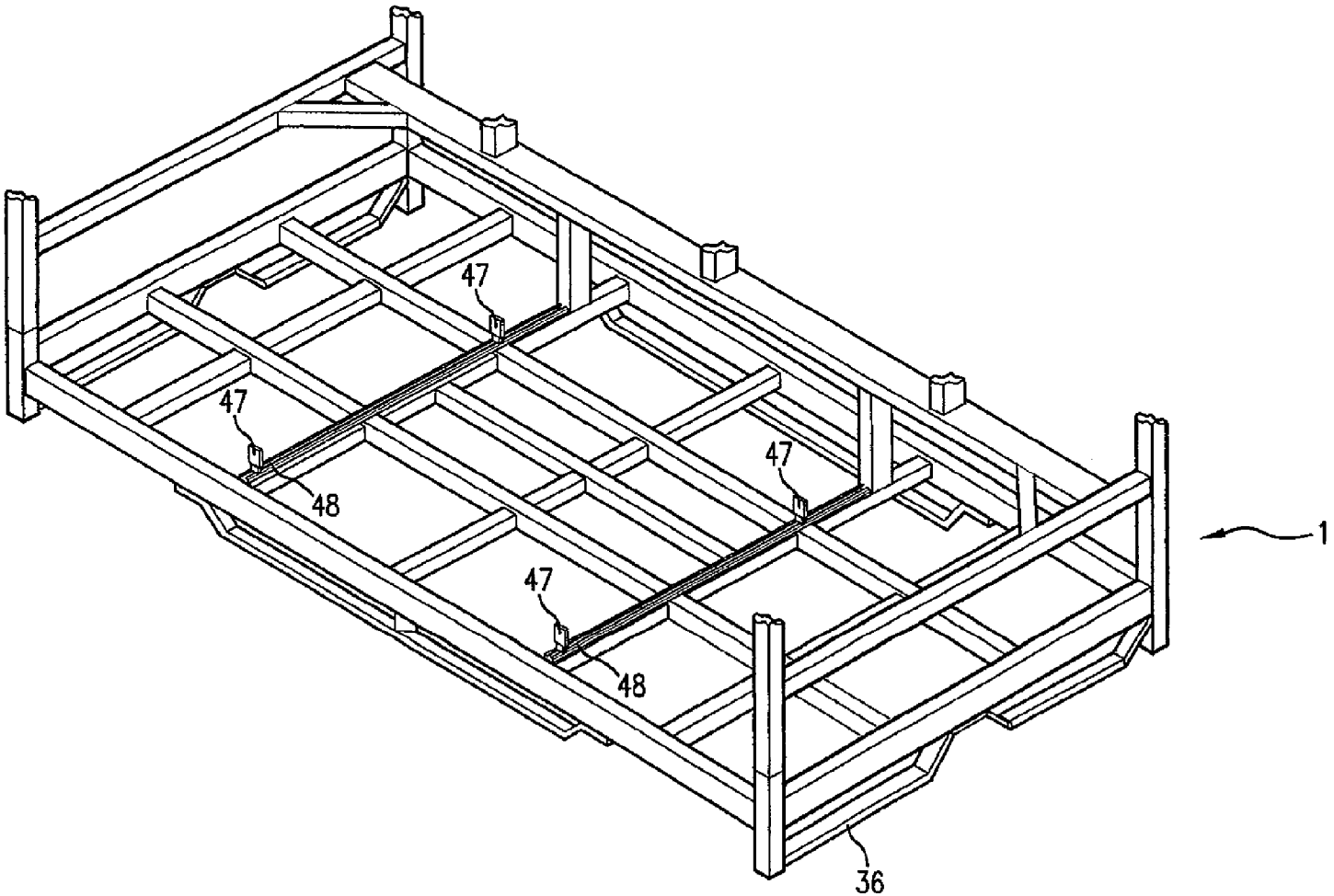
FIG. 13 is view in perspective of the lower half of a container of this invention showing the bottom stops of this invention and the slide channel for adjusting such stops.

Occasionally, the container 1 of this invention has to be modified with bottom stops 47 shown in FIG. 13 which is the bottom half of a container 21. The bottom stops 47 are adjustable from front to back to front in a channeled slot 48.

It is contemplated within the scope of this invention to provide struts and braces in the container 1 to ensure stability and rigidity of the structure.

It is also contemplated within the scope of this invention to provide flat panels as a floor on top of the base 3 of the container 1. It is further contemplated within the scope of this invention to provide a metal mesh floor 49 as shown in one section of the base in FIG. 2.

It is still contemplated within the scope of this invention to coat or paint the container and adjustable rack to protect them from the elements.

It is yet another embodiment of this invention to color code the various containers or portions of the containers to accommodate various component identification or to identify the ultimate end user of the contents of the container.

What is claimed is:

1. An adjustable rack for a parts container, said adjustable rack comprised of a support ladder having a top rail and a bottom rail and at least three vertical support posts; each said vertical support having a top end, a bottom end, and oppositely opposed side walls, there being a slider bar mount attached near the top end and the bottom end of each of the oppositely opposed side walls of each of the support posts, wherein slider bars are mounted in and supported by said slider bar mounts such that the slider bars are essentially suspended between the top rail and the bottom rail of the support ladder;

at least two support and adjustment posts having a front surface and slidably mounted on and essentially between the top and bottom slider bars, said support and adjustment posts having a plurality of horizontal slots mounted on the front surface thereof;

there being an adjustable arm mounted on each support and adjustment post, each adjustable arm comprised of a mounting bracket having a back wall, one side wall, and a front wall, said front wall having an internal surface and mounted on the internal surface, at least two locking pins that are insertable into the horizontal slots of the support and adjustment post;

an arm rail attached essentially horizontally to the front wall of the mounting bracket.

* * * * *